United States Patent [19]

Inaba et al.

[11] Patent Number: 4,900,277

[45] Date of Patent: Feb. 13, 1990

[54] CONNECTOR

[75] Inventors: Shigemitsu Inaba; Kazuto Ootaka, both of Shizuoka, Japan

[73] Assignee: Yazaki Corporation, Japan

[21] Appl. No.: 259,712

[22] Filed: Oct. 19, 1988

[30] Foreign Application Priority Data

Oct. 19, 1987 [JP] Japan ..... 62-261734

[51] Int. Cl.[4] ..... H01R 13/514

[52] U.S. Cl. ..... 439/752; 439/465; 439/471

[58] Field of Search ..... 439/465, 467, 470, 471, 439/595, 596, 744, 752

[56] References Cited

U.S. PATENT DOCUMENTS 4,037,906 7/1977 Jayne ..... 439/467 X
4,341,431 7/1982 Woratyla ..... 439/471

FOREIGN PATENT DOCUMENTS 54-79990 6/1979 Japan .
58-14684 1/1983 Japan .

*Primary Examiner*—Eugene F. Desmond
*Attorney, Agent, or Firm*—Wigman & Cohen

[57] ABSTRACT

Enclosed herein is a connector which comprises a connector housing having a rear portion thereof. A plurality of terminal accommodating compartments are formed in the connector housing and each terminal accommodating compartment has an aperture. A plurality of terminals connected to wires, respectively, are inserted into the terminal accommodating compartment through the apertures. A cover member removably attached to the rear portion of the connector housing is provided. The cover member includes a spacer section for securing the terminals in the terminal accommodating compartments when the spacer section is inserted into the apertures and a wire bundling section for bundling the wires therein. The spacing section and wire bundling section are formed on the cover member integrally.

14 Claims, 6 Drawing Sheets

CONNECTOR

BACKGROUND OF THE INVENTION

1. Field of the Invention

This invention relates to a connector, and in particular to a connector for electrical connection of wire-harnesses used in an automobile or the like.

2. Description of the Prior Art

As a connector used for electrical connection of wire-harnesses, there were known various type connectors.

One of such conventional connectors is disclosed in Japanese Laid Open Utility Model Publication No. 58-14684. The connector disclosed comprises a housing with a plurality of terminal accommodating compartments therein and a plurality of terminals fitted into the terminal accommodating compartments. In the housing, there is provided a slit formed in a part of the terminal accommodating compartments. A spacer for securing each terminal in its respective terminal accommodating compartment is inserted into the slit. According to the connector of this invention, since the terminals in the terminal accommodating compartments are secured by the spacer therein, it is possible to prevent the terminals from falling out of the connector.

Another type of connector known in the art is as disclosed in Japanese Laid Open Utility Model Publication No. 54-79990. This type of connector comprises a housing and a case for accommodating wires connected to terminals therein. The case can be divided into two pieces and attached to the end of the housing. The dividable case is provided with lock means for locking the pieces together when the pieces are mated with each other. The dividable case has a narrow cylindrical portion at the rear side thereof and the wires are passed into the cylindrical portion and tightly bundled therein. As a result, according to the connector of this invention, it is possible to prevent the terminals from falling out of the connector and reduce the risk of breakage of the terminals when the wires are pulled with a large force. Furthermore, the penetration of humid air or dust into the inside of the housing can also be prevented, thereby realizing a longer life for the connector.

Each of these conventional connectors has advantages as described above, respectively, so it is expected that if these features were to be incorporated into a single connector, the connector would become immensely advantageous and useful.

However, these features are derived from different inventions with different elements. Therefore, if these features are simply incorporated into a single connector, it is inevitable that the number of parts will have to be increased, thus leading to disadvantages such as troublesome quality control of the parts and increased manufacturing costs. Moreover, since the fitting position of the spacer would be covered by the dividable case, it would be impossible to confirm a proper fitting of the spacer. This would result in the inability to properly insert the spacer into the slit of the housing, thus leading to a poor fitting of the spacer.

SUMMARY OF THE INVENTION

In view of the foregoing disadvantages caused when such elements are incorporated in the hope of combining their respective features into a single connector, the present invention has been made. Accordingly, a main object of the present invention is to provide a connector having all the advantages of the above-mentioned conventional connectors, without increasing the number of parts.

Another object of the present invention is to manufacture such a connector at a relatively low cost.

Yet another object of the present invention is to provide a connector in which it is easy to confirm a proper fitting of the spacer.

In order to attain the above objects, the connector of the present invention comprises a connector housing having a rear portion. Inside the housing are formed a plurality of terminal accommodating compartments, and each terminal accommodating compartment has an aperture. A plurality of terminals each connected to a wire are then accommodated in each terminal accommodating compartment. A means for covering the wires is removably attached to the rear portion of the connector housing. A means for securing the terminals in the terminal accommodating compartments when the securing means is inserted into the aperture is provided integrally on the cover means.

According to the connector having the above structure, the terminals accommodated in the terminal accommodating compartments are secured by the securing means, so it is possible to prevent the terminals from falling out of the terminal accommodating compartments. Further, since the cover means is provided at the rear portion of the housing, the chance breakage of the terminals and wires is eliminated and the penetration of humid air and dust into the housing is prevented thus leading to a lengthened life for the connector.

Furthermore, according to the present invention, it should be noted that these advantages can be obtained from the simple structure that the securing means is integrally provided on the cover means. In other words, according to the present invention, these advantages are attained by the provision of the cover with the spacer as the securing means. As a result, the number of parts can be reduced in comparison with the case in which the elements of the conventional connectors are simply incorporated into a single connector, thereby simplifying the assembly process and reducing the manufacturing cost. In addition, after the spacer is inserted into the apertures in order to secure the terminals, the wires are immediately covered and bundled by the cover, and this remarkably improves the operation steps for assembling the connector having the features mentioned above.

BRIEF DESCRIPTION OF THE DRAWINGS

The objects and advantages of the present invention, as well as the details of the preferred embodiments, will be more fully understood when taken in conjunction with the following drawings, in which.

DETAILED DESCRIPTION OF THE PREFERRED EMBODIMENTS

Figure 1:
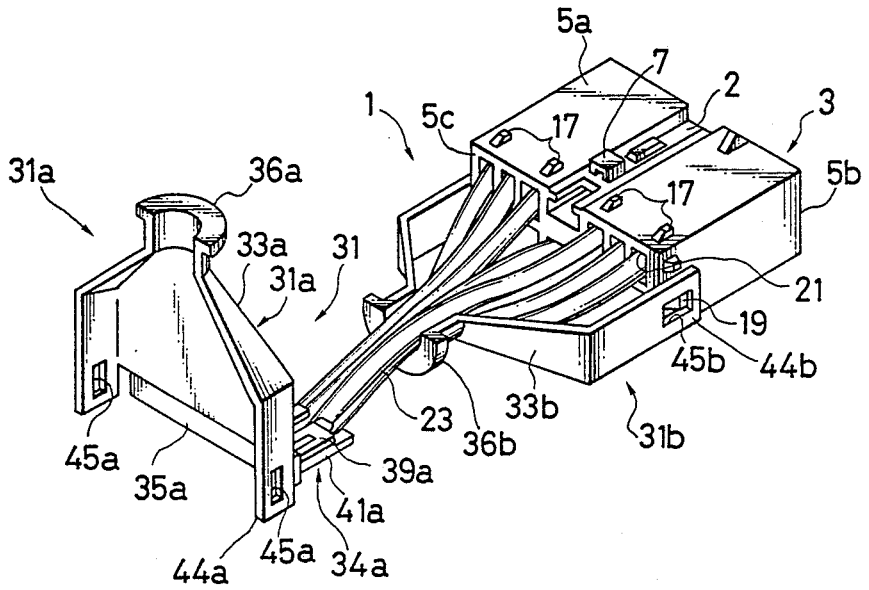
FIG. 1 is a disassembled perspective view of the first embodiment of a connector of the present invention.

Referring now to the drawings, the preferred embodiments of the present invention will be described. Please note that the same number will be used in the drawings to designate the same part in each embodiment.

Figure 2:
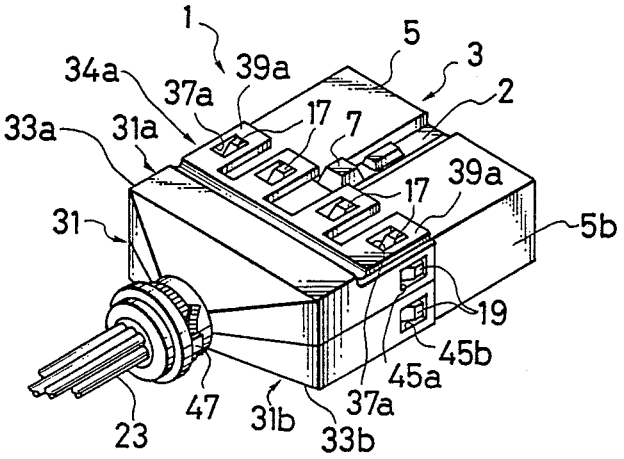
FIG. 2 is a perspective view of the connector.
Figure 3:
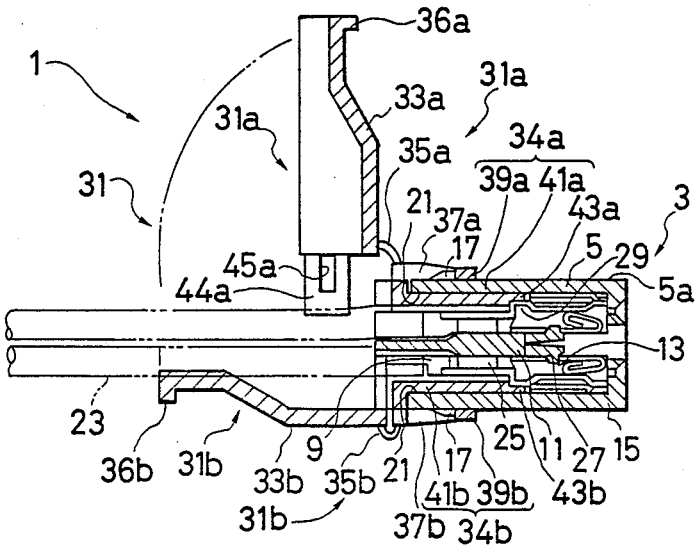
FIG. 3 is a sectional view of the connector.

In FIGS. 1 to 3, the first embodiment of the present invention is shown. In these drawings, a connector 1 comprises a male connector housing 3 and a female connector housing (not shown) to be mated with the male connector housing 3. A recess 2 is formed at the central portion of the upper surface 5*a* of an outer circumferential wall of the housing 3, which extends between the front portion of the connector housing 3 where the female connector is connected, and the rear portion of the connector housing 3 where wires 23 are connected. In the recess 2, there is formed a protrusion 7. The protrusion 7 is engaged with a partner member of the female connector when the female connector is connected to the male connector 1. A plurality of terminal accommodating compartments 9 are provided inside the housing 3. In this embodiment, six compartments 9 are provided in upper and lower rows, respectively. Each of the terminal accommodating compartments 9 extends between the front and rear portions of the connector housings. As shown in FIG. 3, between each pair of the upper and lower terminal accommodating compartments 9, a flexible engagement arm 11 which extends toward the same direction as that of the terminal accommodating compartments 9 is provided. On the tip portion of each flexible engagement arm 11, there are provided two engagement pieces 13 which protrude toward the upper and lower terminal accommodating compartments 9, respectively.

On the rear portion of the upper and lower surfaces 5a of the outer circumferential wall of the connector housing 3, four locking projections 17 are formed, respectively. On the rear portions of the lateral surfaces 5*b* of the outer circumferential wall, locking projections 19 are formed, respectively.

On the rear end surface 5*c* of the outer circumferential wall of the connector housing 3, there are formed a plurality of insertion apertures 21 which communicate with the terminal accommodating compartments 9, respectively. Through the insertion apertures 21, terminals 25, which are connected to the tips of the wires 23, are inserted into the terminal accommodating compartments 9. On each terminal 25, an engagement aperture 27 to be engaged with one of the engagement pieces 13 is formed. Further, on each terminal 25, s shoulder portion 29 is formed to which the tip of a spacer portion of a spacer section is abutted when it is inserted into one of the terminal accommodating compartments 9.

On the rear portion of the connector housing 3, a cover 31 for covering and bundling the wires 23 is coupled. The cover 31 comprises an upper cover member 31*a* and a lower cover member 31*b* which are dividable from each other. The upper cover member 31*a* and lower cover 31*b* have a substantially half-cupped shape symmetrically with respect to each other.

The upper cover member 31*a* and lower cover member 31*b* comprise wire bundling sections 33*a*, 33*b* and spacer sections 34*a*, 34*b*, respectively, which are coupled to the wire bundling sections 33*a*, 33*b* integrally through hinge members 35*a*, 35*b*, respectively. The wire bundling sections 33*a*, 33*b* have gutter-shaped portions 36*a*, 36*b* at the opposite side to the side where the hinge members 35*a*, 35*b*, are provided. The gutter-shaped portions 36*a*, 36*b* form a narrow cylindrical portion when the upper and lower cover members 31*a*, 31*b* are assembled, through which the wires 23 are passed and bundled. Further, the upper and lower cover members 33*a*, 33*b* have extended wall portions 44*a*, 44*b*, which extend in a direction opposite that of the direction the gutter-shaped portions 36*a*, 36*b* extend. On each of the extended wall portions 44*a*, 44*b*, there are formed apertures 45*a*, 45*b* to be engaged with the locking projections 19 of the connector housing 3.

The spacer sections 34*a*, 34*b* are comb-shaped and include four teeth portions each. Each of the teeth portions comprises locking portions 39*a*, 39*b* with apertures 37*a*, 37*b* which engage with the locking porjections 17, and L-shaped spacer portions 41*a*, 41*b* coupled to the end portion of the locking portions 39*a*, 39*b*. At the tip of the spacer portions 41*a*, 41*b*, abutting portions 43*a*, 43*b* are provided which abut the shoulder portion 29 of the terminal 25.

A fastening belt 47 is wound around the cylindrical portion which is formed when the upper and lower cover members 31*a*, 31*b* are assembled.

When the connector having the above structure is to be used, the terminals 25 connected to the tips of the wires 23 are inserted from the rear portion of the connector housing 3 through the insertion apertures 21 into the terminal accommodating compartments 9. After each terminal 25 is accommodated in the compartments 9, the engagement aperture 27 of the terminal 25 is engaged with the engagement piece 13 of the engagement arm 11, whereby the terminal 25 is primarily secured to the terminal accommodating compartment 9.

Thereafter, each of the L-shaped spacer portions 41*a*, 41*b* of the spacer sections 34*a*, 34*b* of the upper and lower cover members 31*a*, 31*b* is inserted into one of the terminal accommodating compartments 9 through a space of the insertion aperture 21 of the connector housing 3. The space is formed above the wire 23 at the insertion aperture 21 of the terminal accommodating compartment 9 of the upper row or below the wire at the insertion aperture 21 of the terminal accommodating compartment 9 of the lower row, respectively.

When the spacer sections 34*a*, 34*b* are pushed toward the connector housing 3, the abutting portions 43*a*, 43*b* of the L-shaped spacer portions 41*a*, 41*b* are abutted to the shoulder portion 29 of the terminal 25. Simultaneously, the locked aperture 37*a* of the locked portion 39*a* is engaged with the locking projection 17 of the upper or lower surface 5*a* of the outer circumferential wall of the connector housing 3. Whereby the terminal 25 is secondarily secured to the terminal accommodating compartment 9.

Then, the wire bundling sections 33*a*, 33*b* which are coupled through the hinge members 35*a*, 35*b* to the spacer sections 34, 34*b* fixed to the connector housing 3 are closed, respectively, to form the cover 31, as shown in FIG. 3. Whereby, the plurality of wires 23 are accommodated in the wire bundling sections 33*a*, 33*b* and the wires 23 are bundled in the cylindrical portion of the cover 31. Then, the apertures 45*a*, 45*b* of the extended wall portions 44*a*, 44*b* are engaged with the locking projections 19 of the connector housing 3. Thereafter, the fastening band 47 is wound around the cylindrical portion.

As stated above, the terminals 23 are securely fixed in the terminal accommodating compartments 9 by the primary engagement between the engagement piece 13 and the engagement aperture 27 of the terminal 25 and the secondary engagement between the shoulder portion 29 of the terminal 23 and the abutting portions 43*a*, 43*b* of the L-shaped spacer portions 41*a*, 41*b*. As a result, it is possible to prevent the terminals from falling out of the connector housing 3, which may be caused by the wires being caught on any automobile parts when the connector is being assembled in the automobile.

Further, the wires 23 are accommodated in the cover 31 which is attached to the rear portion of the connector housing 3 and bundled in the cylindrical portion of the cover 31. Therefore, it is possible to prevent the twisting of wires from having a bad effect on the connecting portions between the wires 23 and terminals 25. In addition to this, it is also possible to prevent penetration of humid air or dust from entering into the inside of the housing, thereby realizing a longer life for the connector.

Furthermore, since the spacer sections 34*a*, 34*b* and the wire bundling sections 33*a*, 33*b* of the cover 31 are formed from a single part, there is no possibility that the fitting of the spacer sections 34*a*, 34*b* can be forgotten. In addition to this, it is also possible to prevent imperfect fitting of the spacer sections 34*a*, 34*b* to the connector housing 3.

Figure 4:
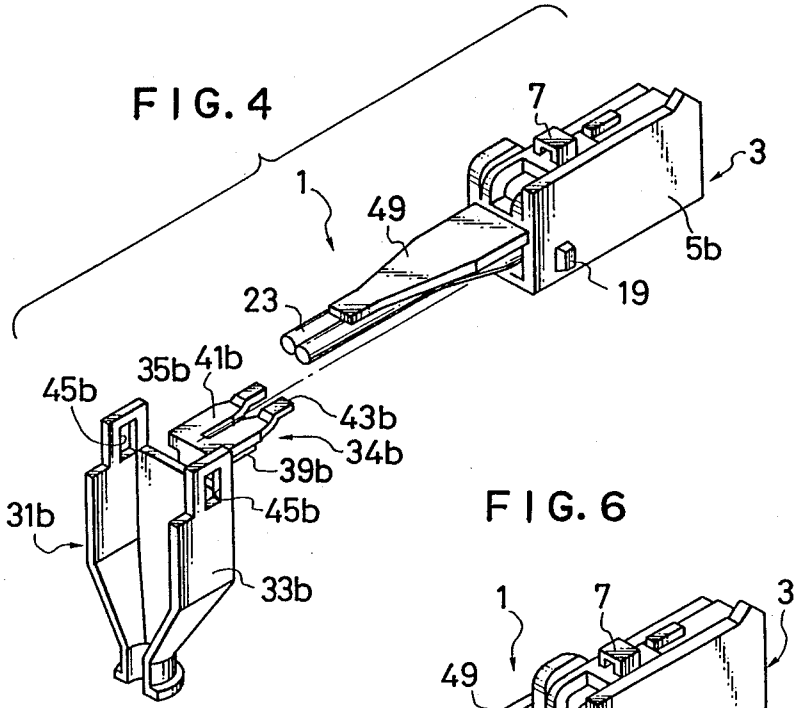
FIG. 4 is a disassembled perspective view of a second embodiment of the connector of the present invention.
Figure 6:
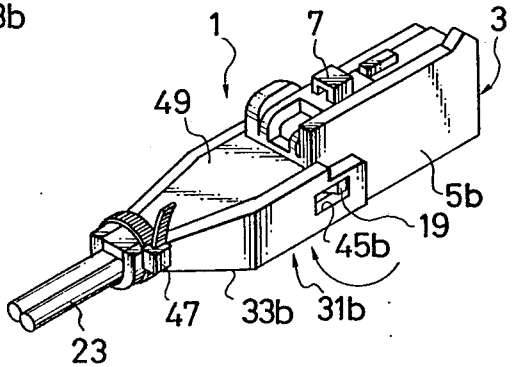
FIG. 6 is a perspective view of the assembled connector of FIG. 5.
Figure 5:
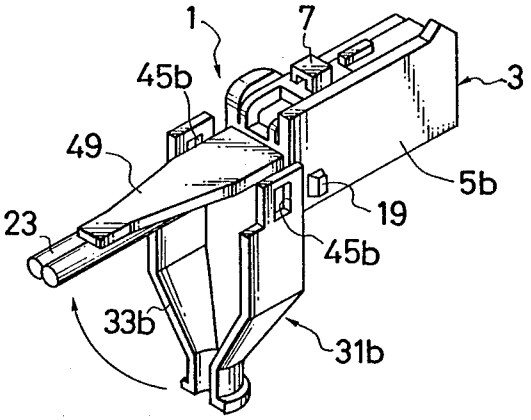
FIG. 5 is a perspective view showing the assembled state of the connector of FIG. 4.

FIGS. 4, 5 and 6 show the second embodiment of the present invention. In these figures, in a connector 1, two terminals (not shown) arranged in parallel and connected to two wires 23, respectively, are accommodated. The structure of the inside of a connector housing 3 is substantially the same as that of the first embodiment except that the structure of the second embodiment is additionally provided with a tongue-shaped plate 49 that extends from the rear portion of the connector housing 3. The tongue-shaped plate 49 forms a cover 31, in which the wires 23 are accommodated, in combination with a lower cover member 31*b* which is substantially the same in structure as that of the first embodiment. Further, the structures of the terminals 25 and the terminal accommodating compartments 9 of this embodiment are also the same as those for the first embodiment. Therefore, any detailed description of those elements is believed to be unnecessary.

As shown in FIG. 4, the wire bundling section 33*b* of the lower cover member 31*b* is connected to a spacer section 34b through a hinge member 35*b*, and the wire bundling section 33*b* and the spacer section 34*b* are normally opened at an angle of about 90°. When the terminals (not shown), which are connected at the ends of the wires 23, are accommodated into the terminal accommodating compartments 9 of the connector housing 3, the primary engagement between the terminals 25 and connector housing 3 is attained in the same manner as that for the first embodiment. After this, the L-shaped spacer portions 41*b* of the spacer section 34b are inserted into apertures of the terminal accommodating compartments 9. Then, abutting projections 43*b* of the spacer portions 41*b* are abutted on each shoulder portion of the terminal 25. In this condition, locked portions 39*b* of the spacer section 34*b* are engaged with locking projections (not shown) provided on the under surface of the connector housing 3, whereby the secondary fixation of the terminals 25 and the connector housing 3 is attained. This condition is shown in FIG. 5. Thereafter, the wire bundling section 33*b* is turned toward the arrow in FIG. 5 at an angle of approximately 90°. As a result, engagement apertures 45*b*, which are formed on both sides of the wire bundling section 33*b*, are engaged with locking projections 19 which are provided on lateral surfaces 5*b* of the outer circumferential wall of the connector housing 3, whereby the wire bundling section 34*b* forms a cover 31 with a narrow cylindrical portion in combination with the tongue-shaped plate 49. This condition is shown in FIG. 6.

In this condition, a band 47 is wound around the narrow cylindrical portion of the cover 31, so that the wires 23 are accommodated in the cover 31 and are tightly bundled by the cylindrical portion.

Structural features and functional effects of this embodiment other than those described above are substantially the same as with the first embodiment previously described and any detailed description of them is also believed to be unnecessary.

Figure 7:
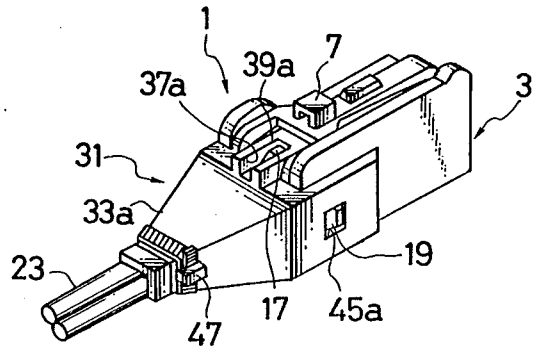
FIG. 7 is a perspective view of a third embodiment of a connector of the present invention.
Figure 8:
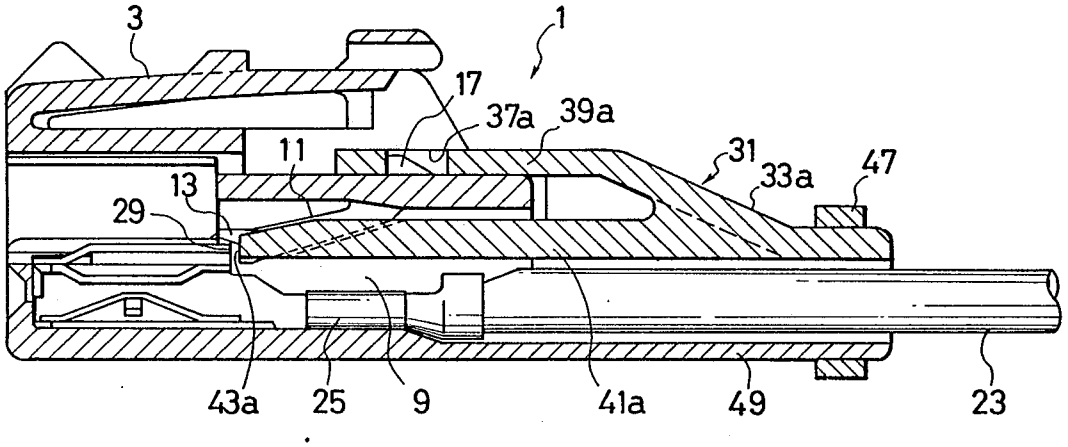
FIG. 8 is a sectional view of the connector of FIG. 7.
Figure 9:
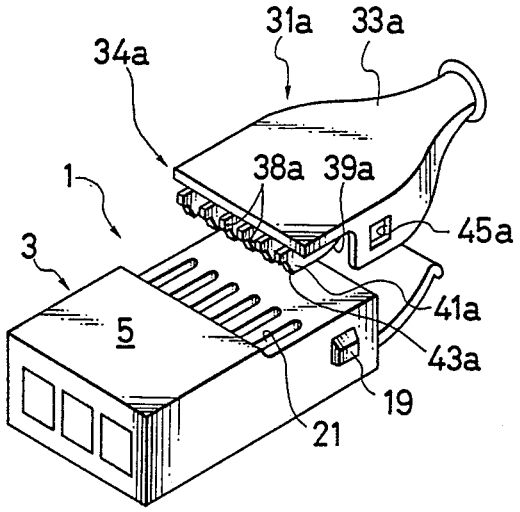
FIG. 9 is a disassembled perspective view of a fourth embodiment of the connector of the present invention.
Figure 10:
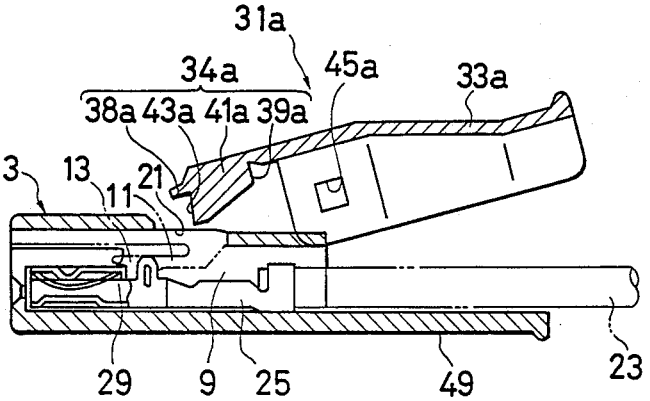
FIGS. 10 to 12 are sectional views showing the conditions in which the cover is attached to the connector housing.

FIGS. 7, 8 and 9 show a third embodiment of the present invention. In this embodiment, a connector housing 3 comprises terminal accommodating compartments (not shown) and a tongue-shaped plate portion 49 extending from the lower side of the rear portion of the connector housing 3. Further, an upper cover member 31*a* comprises a wire bundling section 33*a* having a C-shaped cross section and a spacer section 34*a* formed integrally on the wire bundling section 33*a* without using the hinge member of the other embodiments. The upper cover member 31*a* forms a cover for the wires 23 in combination with the tongue-shaped plate portion 49. Further, in this embodiment, the spacer section 34*a* comprises spacer portions 41*a* and a locking portion 39*a*. The spacer portions 41*a* are formed as V-configurations having two abutting portions 43*a* at the top portion thereof. The locking portion 39*a* has an aperture 37*a* therein which is engaged with a projection 17 formed on the upper surface of the connector housing 3.

When this connector is to be used, the terminals 25 are inserted into the terminal accommodating compartments 9 of the housing 3 from the rear side of the housing 3. Then, the tip portion of each terminal 25 lifts an inclined portion of an engagement arm 11 upwards. Then when the terminals are inserted completely into the compartment 9, the inclined portion is lowered to engage with the shoulder portion 29 of the terminal 25, whereby primary fixation is achieved to the connector housing 3 from the rear side thereof. Next, the spacer portion 41*a* is inserted into an aperture of the terminal accommodating compartments 9. In this case, since the inclined portion of the engagement arm 11 is positioned between the abutting portions 43*a*, the abutting portions 43*a* are abutted on the shoulder portions 29 of the terminals, respectively, whereby secondary fixation is achieved by the engagement of the shoulder portions 29 and the abutting portions 43*a*.

Simultaneously, the aperture 37*a* of the locking portion 39*a* of the spacer section 34*a* is engaged with the projection 17, and engagement apertures 45*a* of the wire bundling section 33*a* are engaged with projections 19 which are provided on the lateral surfaces of the housing 3. In this situation, the upper cover member 31*a* forms the cover 31 in which wires 23 are accommodated and bundled in combination with the tongue-shaped plate portion 49.

The structural features and functional effects of this embodiment other than those described above are substantially the same as with the first and second embodiments previously described, and any detailed description of them is similarly believed to be unnecessary.

FIGS. 9, 10, 11 and 12 show a fourth embodiment of the present invention. In these figures, a male connector 1 comprises a connector housing 3 and an upper cover member 31*a*. The structure of the connector housing 3 is substantially the same as that of the third embodiment. Namely, a tongue-shaped plate portion 49 which extend from the rear side of the connector housing 3 is provided. Three terminal accommodating compartments 9 are formed in the housing 3. In each terminal accommodating compartment 9, there is provided an engagement projection 13 on an engagement arm 11. Above the engagement arm 11, a pair of insertion apertures 21, positioned so as to have one aperture located near either side of the engagement arm 11, are formed on the upper surface of the outer circumferential wall of the connector housing 3. In this embodiment, corresponding to the positions of the terminal accommodating compartments 9, three pairs of slits are formed on the upper surface of the connector housing 3.

The upper cover member 31*a* comprises a wire bundling section 33*a* having a C-shaped cross section and a spacer section 34*a* which is integrally formed on the wire bundling section. The spacer section 34*a* comprises spacer portions 41*a* to be inserted into the insertion apertures 21, which comprises six stabilized plate members, each having an abutting portion 43*a*, respectively, and a locking portion 38*a*, 39*a*. The position and number of spacer portions 41*a* correspond, respectively, to the position and number of insertion slits 21. The locking portion 38*a*, 39*a* comprises first locking edge portions 38*a* engaged with the front side of each insertion slit 21 and second locking edge portions 39*a* to be locked with the rear side of each insertion slit 21.

When this connector is to be used, the terminals 25 connected to the tops of the wires 23 are inserted into the terminal accommodating compartments 9 from the rear side of the connector housing 3. Then, the terminals 25 lift the engagement arm 11 upwards. When the terminals 25 are completely accommodated in the compartments 9, the engagement arm 11 is lowered so that the engagement projections 13 of the engagement arm 11 are in engagement with the shoulder portions 29 of the terminals, respectively. Whereby, primary engagement of the terminals with the connector housing 3 is accomplished.

Figure 11:
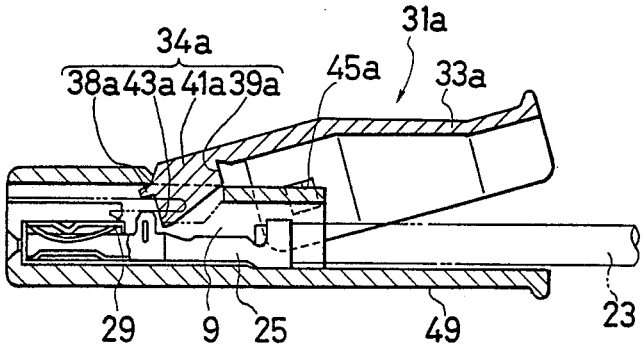
Figure 12:
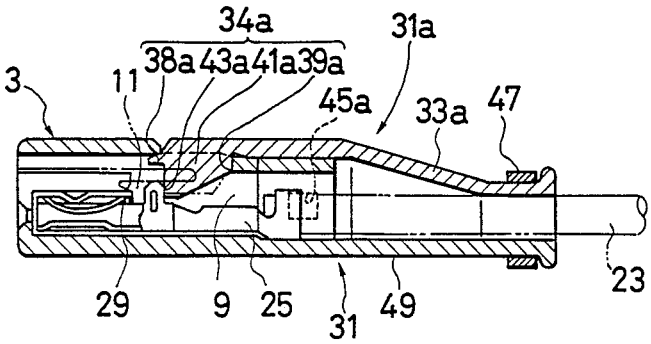

As shown in FIG. 11, thereafter, the upper cover member 31*a* is attached to the housing 3 by inserting spacer portions 41*a* into their corresponding insertion apertures 21. In this situation, the abutting portions 43*a* of the spacer portions 41*a* are abutted on the stabilizer portions of each terminal 25. Then, the first locking edge portions 37*a* are engaged with the front side of each insertion aperture 21 and the second locking edge portions 38*a* are locked with the rear side of each insertion aperture 21. Thus, secondary engagement of the terminals 25 and the connector housing 3 is accomplished. Further, engagement apertures 45*a* formed on the wire bundling section 33*a* are engaged with locking projections 19 formed on the lateral side of the connector housing 3. In this situation, the upper cover member 31*a* forms a cover 31 for the wires in combination with the tongue-shaped plate portion 49 of the housing 3, in which the wires 23 are accommodated in the cover and bundled at the narrow cylindrical portion formed at the rear end of the cover 31.

In all of embodiments described above, a fastening means such as a fastening belt 47 is used to further secure the cover 31*a* to the housing 3 or to further secure the covers 31*a* and 31*b* to each other. It is to be additionally noted that it is preferable to form the housing 3 and the covers 31*a* and 31*b* from electrically resistant material.

The structural features and functional effects of this embodiment other than those described above are substantially the same as those for the first and second embodiments previously described, and any detailed description of them is believed to be unnecessary.

It must be understood that the invention is in no way limited to the above embodiments and that many changes may be brought about therein without departing from the true scope of the invention as defined by the appended claims.

What is claimed is:

1. A connector, comprising:

a connector housing having a rear portion thereof;

a plurality of terminal accommodating compartments formed inside said connector housing, each of said terminal accommodating compartments having an aperture therein; and a plurality of terminals connected to wires, respectively, said terminals being inserted into said terminal accommodating compartments; and cover means removably attached to said rear portion of said connector housing said cover means having formed integrally thereon means for bundling said wires therein and means for securing said terminals in said terminal accommodating compartments when said terminal securing means is inserted into said apertures.

2. A connector as claimed in claim 1, wherein said apertures are formed on the rear portion of said connector housing, through which said terminals are inserted into said terminal accommodating compartments.

3. A connector as claimed in claim 2, wherein said terminal securing means includes spacing members that are inserted into said apertures.

4. A connector as claimed in claim 3, wherein said terminal securing means further comprises means for locking said terminal securing means to said connector housing, such that engagement of the locking means guarantees a proper securement of the terminals.

5. A connector as claimed in claim 4, wherein said cover means comprises first and second cover members each having symmetrical configurations with respect to each other, and each of said cover members including a wire bundling section and a spacing section as said terminal securing means having said spacing members and said locking means, said spacing section being coupled to said wire bundling section through a hinge member, and said cover means including a combination of said wire bundling sections of said first and second cover members.

6. A connector as claimed in claim 5, wherein said wire bundling sections of said first and second cover members form a narrow cylindrical portion when they are combined, said wires having passed through said cylindrical portion being bundled therein.

7. A connector as claimed in claim 6, wherein each of said wire bundling sections of said first and second cover members has engagement means engaged with said connector housing.

8. A connector as claimed inclaim 4, wherein said connector housing comprises a tongue-shaped portion extending from the rear portion of said connector housing, and said cover means comprises a half-cup-shaped cover having a spacing section and a wire bundling section to be fitted to said tongue-shaped portion, said wire bundling means being formed from said wire bundling section of the half-cup-shaped cover and said tongue-shaped portion.

9. A connector housing as claimed in claim 8, wherein said wire bundling section of said half-cup-shaped cover and said tongue-shaped portion form a narrow semi-cylindrical portion when they are fitted together, said wires having passed through said cylindrical portion being bundled therein.

10. A connector as claimed in claim 9, wherein said spacing section and said wire bundling section are coupled with a hinge member.

11. A connector as claimed in claim 9, wherein said spacing section and said wire bundling section are coupled directly.

12. A connector as claimed in claim 9, wherein said connector housing has an upper surface, said apertures being formed on said upper surface of said connector housing, and said spacing members being inserted into said apertures, respectively, and engaged with the terminals in the terminal accommodation compartments.

13. A connector for connecting a plurality of wires having a terminal connected to one end of each of said wires, comprising:

a connector housing having a rear portion thereof;

a plurality of terminal accommodating compartments, for accommodating the terminals therein, formed inside said connector housing, each of said terminal accommodating compartments having an aperture therein; and cover means removably attached to said rear portion of said connector housing, said cover means having formed integrally thereon means for building said wires therein and means for securing said terminals in said terminal accommodating compartments.

14. A connector, comprising:

a connector housing having a rear portion thereof;

a plurality of terminal accommodating compartments formed inside said connector housing, each of said terminal accommodating compartments having an aperture therein; and a plurality of terminals connected to wires, respectively, said terminals being inserted into said terminal accommodating compartments;

first means for securing said terminals in said terminal accommodating compartments when said terminals are inserted into said terminal accommodating compartments; and cover means removably attached to said rear portion of said connector housing, said cover means including means for bundling said wires therein and second means for securing said terminals in said terminal accommodating compartments in addition to said first securing means when said terminal securing means is inserted into said apertures, and said wire bundling means and said terminal securing means being formed on said cover means integrally.

* * * * *

UNITED STATES PATENT AND TRADEMARK OFFICE

CERTIFICATE OF CORRECTION

PATENT NO. : 4,900,277

DATED : February 13, 1990

INVENTOR(S) : INABA ET AL

It is certified that error appears in the above-identified patent and that said Letters Patent is hereby corrected as shown below:

Column 3, line 55, please change "s" to --a--;

line 65, please change "symmetrically" to --symmetrical--.

Column 4, line 19, please change "porjections" to --projections--;

line 42, please change "of" (first occurrence) to --in--;

line 52, please change "locked" (second occurrence) to --locking--;

line 60, please change "34" to --34a--.

Column 5, line 3, please change "23" to --25--;

line 8, please change "23" to --25--.

Column 6, line 47, please change "compartment" to --compartments--;

line 49, after "achieved", please insert --. Thereafter, the upper cover member 31a is attached--.

Column 7, line 12, please change "extend" to --extends--.

Column 8, line 3, after "of" please insert --the--.

UNITED STATES PATENT AND TRADEMARK OFFICE

CERTIFICATE OF CORRECTION

PATENT NO. : 4,900,277

DATED : February 13, 1990

INVENTOR(S) : INABA ET AL

It is certified that error appears in the above-identified patent and that said Letters Patent is hereby corrected as shown below:

Column 9, claim 8, line 1, please change "inclaim" to --in claim--;

claim 9, lines14 and 15, please change "cylindrical" to --semi-cylindrical--;

claim 12, line 27, please change "accommodation" to read --accommodating--.

Column 10, claim 13, line 6, please change "building" to read --bundling--.

Signed and Sealed this

Third Day of September, 1991

*Attest:*

*Attesting Officer*

HARRY F. MANBECK, JR.

*Commissioner of Patents and Trademarks*